United States Patent [19]

Joe et al.

[11] Patent Number: 4,598,485

[45] Date of Patent: Jul. 8, 1986

[54] SLIP-RESISTANT DISPOSABLE SHOE COVER

[76] Inventors: Chun-Chuan Joe; Fa-Chang Joe, both of 2578 Daytona Ave., Hacienda Hgts., Calif. 91745

[21] Appl. No.: 743,383

[22] Filed: Jun. 10, 1985

[51] Int. Cl.[4] ..... A43B 3/18

[52] U.S. Cl. ..... 36/7.2; 36/7.4; 36/7.7; 2/DIG. 7

[58] Field of Search ..... 36/7.2, 7.1 R, 7.4, 36/7.7, 7.3, 8.1, 8.4, 9 A, 9 R; 2/DIG. 7

[56] References Cited

U.S. PATENT DOCUMENTS

| | | | |
|---|---|---|---|
| 1,522,890 | 1/1925 | Krap . | |
| 2,062,909 | 12/1936 | Kenagy, Sr. et al. | 36/11.5 |
| 2,288,199 | 6/1942 | Levy | 36/10 |
| 2,389,414 | 11/1945 | Crofut, Jr. | 36/10 |
| 2,463,296 | 3/1949 | Moore | 36/10 |
| 2,497,528 | 2/1950 | Baker | 36/10 |
| 2,627,126 | 2/1953 | France | 36/9 A |
| 2,714,771 | 8/1955 | Olfene | 36/9 |
| 2,771,691 | 11/1956 | Luchs | 36/10 |
| 3,148,378 | 9/1964 | Tibbitts | 36/9 A |
| 3,337,770 | 8/1967 | Saraceni et al. | 36/7.1 R |
| 3,358,188 | 12/1967 | Zimmon | 36/7.1 R |
| 3,426,454 | 2/1969 | Mitchell et al. | 36/2.5 |
| 3,648,109 | 3/1972 | Tims et al. | 36/9 R |
| 3,798,503 | 3/1974 | Larsh et al. | 36/9 R |
| 3,801,868 | 4/1974 | Bryant | 36/9 A |
| 3,824,714 | 7/1974 | Glassman | 36/7.1 R |
| 4,019,265 | 4/1977 | Epstein | 36/7.1 R |
| 4,145,822 | 3/1979 | Mitchell et al. . | |
| 4,194,308 | 3/1980 | Karlsson | 36/9 R |
| 4,296,499 | 10/1981 | Patterson et al. . | |

*Primary Examiner*—Werner H. Schroeder
*Assistant Examiner*—Mary A. Ellis
*Attorney, Agent, or Firm*—Sheldon & Mak

[57] ABSTRACT

A slip resistant, disposable shoe cover with a body formed of a flexible, foldable, sheet material, the shoe cover comprising a bottom rib formed of a strip of flexible, stretchable, resilient, and slip resistant material. The bottom rib extends along and through a bottom seam of the shoe cover, and is at last partly exposed on the outside of the shoe cover. The bottom rib provides slip resistance, and it also serves to hold the shoe cover snugly over the wearer's shoe.

14 Claims, 4 Drawing Figures

SLIP-RESISTANT DISPOSABLE SHOE COVER

BACKGROUND

This invention relates to a slip resistant disposable shoe cover.

In today's hospital operating rooms, sanitary disposable shoe covers are an important link in the maintenance of hygenic conditions. The shoe covers prevent contamination of the wearer's shoe, and equally as important, the covers prevent contamination of the sterilized operating room environment by the wearer's shoe.

Modern operating rooms generally have smooth floor surfaces, substantially absent of crevices or irregularities in which dirt and germs can accumulate. This facilitates the effort to keep the operating room sanitized. However, smooth floors can pose serious hazards.

Conventional disposable shoe covers are generally made of non-woven fabrics, e.g. polypropylene fabrics. The fabric is cut to form a blank. The edges of the blank are then sewn together to form an elongated, sock-shaped bag, with an opening near one end for the insertion of the wearer's foot. Narrow strips of elastic material are stretched and sewn in as integral parts of the seams. The elastic strips yieldingly gather the material of the shoe cover along the seams, and serve to hold the shoe cover snugly about the wearer's shoe. The main advantages of this design are softness, lightweight, comfort, low cost, and availability of material.

However, non-woven fabrics generally afford little slip resistance. The medical personnel performing the operation usually have to stand for hours on their feet; which also means that they are standing on the fabric of the shoe covers which fit over their shoes. Therefore surefootedness has been a problem in operating rooms. The problem is at the same time physical and psychological. When you need steady hands in performing a delicate procedure, and yet you cannot be sure of your footing, the hazard to the patient is obvious.

Efforts have been taken to solve this problem, mainly by one of two methods. This first is by incorporating a non-slip bottom on the disposable shoe cover. However, this method requires complicated manufacturing procedures, and increases the cost of the shoe cover to where it is not price competitive. The added weight and stiffness of the non-skid bottom also reduced comfort to the wearer.

The other method involves using a non-slip sheet material to form the blank. Non-woven fabrics coated with a non-skid coating have been used. For example, Du Pont Co. markets such as non-skid fabric under the name Tyvek TM. However, non-skid fabrics are expensive. Furthermore, because non-skid fabrics are generally not as soft as uncoated fabrics, the shoe covers made of non-skid fabrics can be uncomfortable.

What is needed is a slip-resistant disposable shoe cover which is low in cost and easy to manufacture, makes use of readily available materials, and is comfortable to wear.

SUMMARY

The shoe cover of this invention solves the problem of slipping by incorporating a novel bottom rib into a shoe cover. A shoe cover according to the present invention comprises a foot-shaped body formed of flexible foldable sheet material, the body comprising an inside surface and an outside surface, the outside surface including a bottom having a bottom seam which runs longitudinally along the length of the bottom. The bottom rib is formed of a strip of flexible, stretchable, resilient, and slip resistant material. The bottom rib has a stretched length and a relaxed length. The relaxed length is shorter than the length of bottom seam. The bottom rib extends along and through the bottom seam, and is affixed to the bottom seam such that the bottom rib yieldingly gathers the material of the bottom along the bottom seam, with the bottom rib being at least partly exposed on the outside of the cover along the bottom seam.

In an alternate version, the rib is at least partly exposed on both sides of the cover along the bottom seam.

The bottom rib is preferably formed of rubber, preferably pure crepe rubber, or natural rubber latex.

DRAWINGS

These and other features, aspects, and advantages of the present invention will become better understood with reference to the following description, appended claims, and accompanying drawings where:

DESCRIPTION

Figure 1:
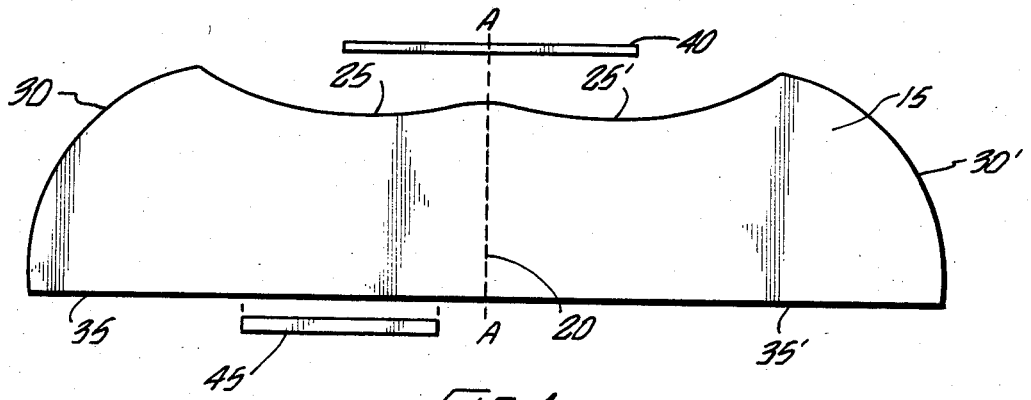
FIG. 1 is a front view of a blank cut out from a sheet material, and of strips of elastic material, all to be used to form the shoe cover of this invention.

FIG. 1 shows the components for forming the shoe cover 10 of this invention. A blank 15 can be cut out of a flexible foldable sheet material. The blank 15 can be symmetrical about the line A—A, which is the rear edge 20 of a shoe cover 10 to be formed from the blank 15. The blank 15 has a pair each of top edges 25 and 25', front edges 30 and 30', and bottom edges 35 and 35'. There is a flexible, stretchable, and resilient top elastic strip 40. There is also a bottom rib 45 formed of a strip of flexible, stretchable resilient, and slip-resistant material.

The blank 15 can be cut from any flexible and foldable sheet materials. For example, almost any fabric, woven or non-woven, can be used.

In one preferred version, the blank 15 is cut out of a non-woven fabric which is soft but strong, is light in weight, allows breathing, is low in cost and is readily available. Exemplary of suitable fabrics are Rayon TM, Terelon TM, and other fabrics that are petrochemical in origin. A preferable fabric is a polypropylene fabric marketed by Kimberly-Clark Co. and many other manufacturers all over the world under the name "Poly Spunbound". Either or both of the top plastic strip 40 and the bottom rib 45 can be formed of rubber and/or natural rubber latex, preferably pure crepe rubber.

The top elastic strip 40 has a stretched length and a relaxed length, the relaxed length of the top elastic strip 40 being shorter than the combined lengths of the two top edges 25 and 25'. The bottom rib 45 has a stretched length and a relaxed length, the relaxed length of the bottom rib 45 being shorter than the length of each of the two bottom edges 35 and 35'. The ratio of the stretched length to the relaxed length can be from about 1.5:1 to about 3:1.

Figure 2:
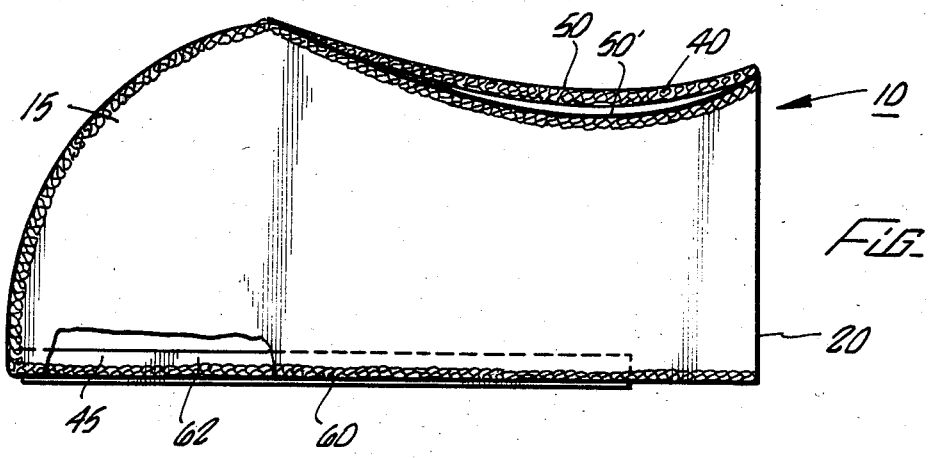
FIG. 2 is a front view, partly broken away, of the shoe cover of this invention shown inside out, with the elastic strips being incorporated in the seams, the elastic strips being shown stretched.

Referring to FIG. 2, top elastic strip 40 is then affixed, while it is in a stretched state, to top edges 25 and 25' to form top seams 50 and 50', respectively. The two front edges 30 and 30' are affixed to each other to form front seam 55. The two top seams 50 and 50' are joined at their two ends to each other, and in the front to the front seam 55, and in the back to rear edge 20. The two top seams 50 and 50' together define the opening for insertion of the wearer's foot. The bottom rib is kept stretched and placed between the bottom edges 35 and 35', and then all three are affixed together to form a bottom seam 60. The method of affixation can be conventional methods such as sewing, e.g., by the use of an overlock machine. The stitches at the top seams 50 and 50' preferably pass through the fabric and the stretched top elastic strip 40. The stitches at the bottom seam 60 preferably pass through the fabric and the stretched bottom rib 45.

Currently there are machines that will perform the steps of cutting out the blank 15 and forming the seams simultaneously. For example, Juki Co. of Japan markets such a machine.

Figure 3:
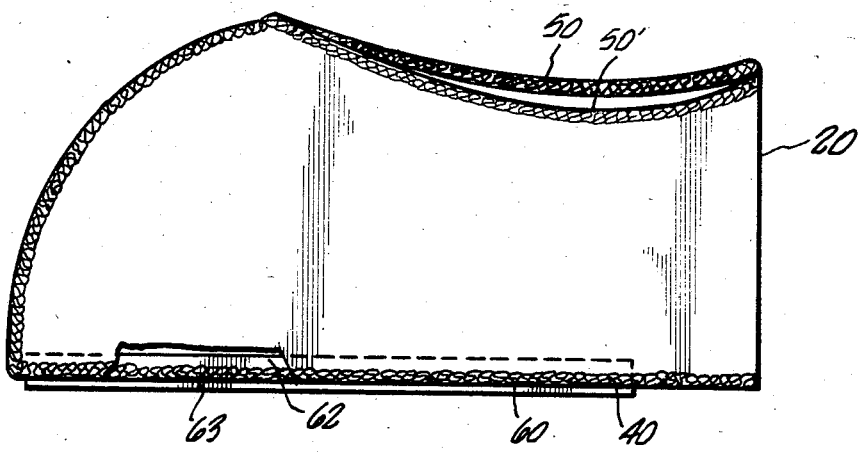
FIG. 3 is similar to FIG. 2 except the bottom rib is is exposed on both sides of the bottom seam.

FIG. 2 shows the finished shoe cover 10, inside out, after the seams have been formed. Note that the top elastic strip 40 and the bottom rib 45 are shown in their stretched states. As shown in FIG. 2, part of the bottom rib 45, the outside exposed rib 62, extends outside of the bottom seam 60 along at least part of the length of the bottom seam 60. In an alternate version, as shown in FIG. 3 (which is similar to FIG. 2 except for the following aspect), another part of the bottom rib 45, the inside exposed rib 63, also extends beyond the bottom seam 60 on the side opposite to that of the outside exposed rib 62. That is, the bottom rib 45 extends beyond both sides of the bottom seam 60, along at least part of the length of the bottom seam 60.

Figure 4:
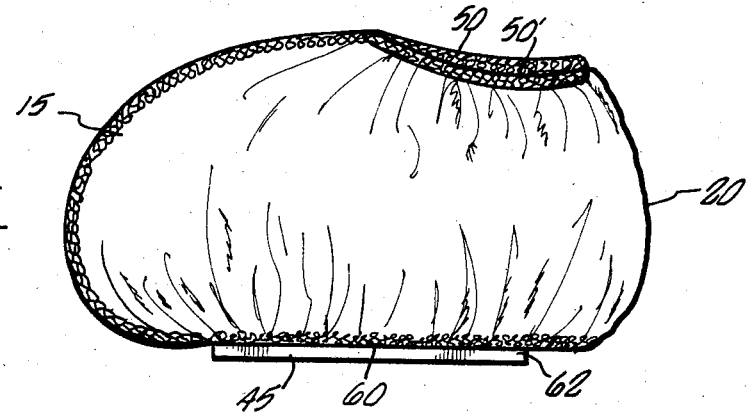
FIG. 4 is a front perspective view of the shoe cover of this invention, with an elastic strip being exposed on the outside of the bottom of the cover, and with the material of the cover being yieldingly gathered about the elastic strips.

As shown in FIG. 4, the finished product, shoe cover 10, is then turned inside-out, so that the outside exposed rib 62 is on the bottom of the shoe cover 10, and being exposed on the outside of the shoe cover 10. The top elastic strip 40 and the bottom rib 45 are allowed to return to their relaxed lengths, so that they yieldably gather the material of the shoe cover 10 proximate to the top seams 50 and 50', and proximate to the bottom seam 60, respectively.

Unstretched, as shown in FIG. 4, the shoe cover 10 should be shorter than the wearer's shoe, while in the stretched state, it should be large enough to accommodate the wearer's shoe. To wear the shoe cover 10, the wearer stretches top seams 50 and 50' to form an opening, and insert his shoe-cladded foot through that opening into the shoe cover 10. The bottom rib 45 is also stretched to accommodate the length of the shoe. The tension in the bottom rib 45 keeps the shoe cover 10 fitting snugly over the wearer's shoe. The tension in the top elastic strip 40 keeps the top seams 50 and 50' around the wearer's ankle and prevents the shoe cover 10 from falling off.

It is preferable that the outside exposed rib 62, and if applicable, the inside exposed rib 63, are both exposed beneath the areas of the wearer's shoes where the weight of the wearer is brought to bear, e.g., area beneath the balls and heels of the wearer's feet. To simplify the manufacturing process, it is preferable that the bottom rib 45 be exposed substantially along the entire length of the bottom seam 60.

When the wearer stands on the shoe cover 10, at least part of the outside exposed rib 62 is pressed against the floor by the weight of the wearer. Since the bottom rib 45 is formed of a slip-resistant material, the requisite friction is provided to provide surefootedness. In the version also having an inside exposed rib 63, the inside exposed rib 63 is pressed against the sole of the wearer's shoe, and prevents the wearer's shoe from slipping against the inside of the bottom of the shoe cover 10.

For optimum performance and comfort to the wearer, there are limitations as to the thicknesses and widths of the elastic strip 40 and the bottom rib 45. When it has a relaxed length, the elastic strip 40 is preferably less than about $\frac{1}{8}$ inch in thickness and less than about $\frac{1}{4}$ inch in width. Wider and thicker strips may cause discomfort. When it has a relaxed length, the bottom rib 45 is preferably less than about $\frac{1}{4}$ inch in thickness and less than about $1\frac{1}{2}$ inches in width. Too thick a rib causes discomfort to the foot of the wearer, as he has to stand on the rib. Too wide a rib gives a wobbly feel when the wearer slides his foot against the floor in a lateral direction. Preferably the width of the outside exposed rib 62 is between from about 1/16 to about $\frac{3}{8}$ inch. If the exposed rib is too narrow, the slip resistance is insufficient. If the exposed rib is too wide, it gives a wobbly feel. The width of the inside exposed rib 63 is between about 1/16 to about $\frac{3}{8}$ inch because of the same concerns.

There are many advantages in the shoe cover of this invention, especially the version having a bottom rib 45 formed of rubber.

Rubber has a much higher coefficient of friction when compared to uncoated non-woven fabrics. Therefore the shoe cover 10 of this invention gives much higher slip resistance. Moreover, with the bottom rib 45 extending along substantially the entire length of bottom seam 60, slip resistance is available even if the wearer steps on other than level ground, e.g. pipes.

There is no appreciable increase in material costs in comparison to conventional disposable shoe covers. All the materials are readily available. Non-woven fabrics used in conventional shoe covers can be used to form the body of the shoe cover 10, no special non-skid fabrics are necessary. The rubber strip suitable for forming the bottom rib 45 comprises only a minor component of the total material cost. Further, it is comparable in cost to the thinner and narrower strips of elastic material usually used in a disposable shoe cover of conventional design. In general the cost of a rubber strip is inversely proportional to its width and thickness.

There is also no increase in manufacturing costs. The manufacturing steps are comparable to those used for conventional disposable shoe covers. The only difference is that part of the bottom rib 45 must be exposed beyond the bottom seam 60 to form the outside exposed rib 62, and if applicable, the inside exposed rib 63. Existing equipment can be used without extensive retooling or modifications. No retraining of skilled labor is necessary.

The rubber bottom rib 45 is pliant and resilient. Even standing on the rib for an extended period of time will not cause discomfort. In fact the cushiony feel of the bottom rib 45 provides for welcomed relief for extended standing.

The incorporation of the bottom rib 45 does not substantially affect the aesthetics of the shoe cover 10.

Rubber is a sanitary material commonly found in the operating room environments. In fact, surgical gloves are commonly made of rubber. There is no problem with using materials that have not yet been extensively tested, or not yet found conclusively to be safe.

The bottom rib 45 serves a dual function. It provides slip resistance, and it also serves to hold the shoe cover 10 snugly against the wearer's shoe.

Although the present invention has been described in considerable detail with regard to certain versions thereof, other versions are possible. For example, the bottom rib 45 and/or the top elastic strip 40 can each comprise discrete segments, instead of being continuous. Also, the bottom seam containing the bottom rib need not necessarily run longitudinally along the length of the bottom of the shoe cover. For example, there can be one or more bottom seams each having a bottom rib 45, with each seam running in a direction other than along the length of the bottom. Moreover, elastic materials other than rubber can be used for the top elastic strip 40 and/or the bottom rib 45. Therefore, the spirit and scope of the appended claims should not necessarily be limited to the description of the preferred versions contained herein.

What is claimed is:

1. A slip-resistant disposable shoe cover comprising:

(a) a foot-shaped body formed of flexible foldable sheet material, the body comprising an inside surface and an outside surface, the outside surface including a bottom having a bottom seam which runs longitudinally along the length of the bottom;

(b) a bottom rib formed of a strip of flexible, stretchable, resilient, and slip-resistant material, the bottom rib having a stretched length and a relaxed length, the relaxed length being shorter than the length of the bottom seam, the bottom rib extending along and through the bottom seam, and being affixed to the bottom seam such that the bottom rib yieldably gathers the material of the bottom along the bottom seam, with the bottom rib being at least partly exposed on the outside of the cover along the bottom seam, and at least partly exposed on the inside of the body along the bottom seam.

2. A slip-resistant disposable shoe cover comprising:

(a) a foot-shaped body formed of flexible foldable sheet material, the body comprising an inside surface and an outside surface, the outside surface including a bottom having a bottom seam which runs longitudinally along the length of the bottom;

(b) a bottom rib formed of a strip of flexible, stretchable, resilient, and slip-resistant material, the bottom rib having a stretched length and a relaxed length, the relaxed length being shorter than the length of the bottom seam, the bottom rib extending along and through the bottom seam, and being affixed to the bottom seam such that the bottom rib yieldably gathers the material of the bottom along the bottom seam, with the bottom rib being at least partly exposed on the outside of the cover along the bottom seam.

3. The shoe cover of claim 2 wherein the bottom rib is from about 1/64 to about ¼ inch in thickness.

4. The shoe cover of claim 3 wherein the bottom rib is from about ¼ to about 1½ inch in width.

5. The shoe cover of claim 4 wherein the bottom rib has an exposed width of from about 1/16 to about ⅜ inch outside of the bottom.

6. The shoe cover of claim 2 wherein the bottom rib is also at least partly exposed on the inside of the body along the bottom seam.

7. The shoe cover of claim 6 wherein the bottom rib has an exposed width of from about 1/16 to about ¼ inch inside of the bottom.

8. The shoe cover of claim 2 wherein the bottom rib is formed of a material selected from the class consisting of rubber and natural rubber latex.

9. A slip resistant disposable shoe cover comprising:

(a) a body formed of flexible foldable sheet material, the body comprising an inside surface and an outside surface, the outside surface including a bottom having a bottom seam which runs longitudinally along the length of the bottom;

(b) a bottom rib formed of rubber, the bottom rib being flexible, stretchable, resilient, and slip resistant, and having a stretched length and a relaxed length, the relaxed length being shorter than the length of the bottom seam, the bottom rib being between about 1/64 to about ¼ inch in thickness, and between about ¼ to about 1½ inch in width, the bottom rib extending along and through the bottom seam, and being affixed to the bottom seam such that the bottom rib yieldably gathers the material of the bottom along the bottom seam, with the bottom rib being at least partly exposed on the outside of the cover along the bottom seam.

10. The shoe cover of claim 9 wherein the bottom rib has an outside exposed width of from about 1/16 to about ⅜ inch outside of the bottom.

11. The shoe cover of claim 9 wherein the bottom rib is also at least partly exposed on the inside of the body along the bottom seam.

12. The shoe cover of claim 11 wherein the bottom rib has an exposed width of from about 1/16 to about ¼ inch inside of the bottom.

13. A method for forming a slip-resistant disposable shoe cover, the method comprising the steps of:

(a) selecting a flexible foldable sheet material;

(b) cutting a blank out of the sheet material, the blank being suitable for forming a shoe cover with a bottom having a bottom seam which runs longitudinally along the length of the bottom;

(c) selecting a bottom rib comprising a strip of flexible, stretchable, resilient and slip-resistant material, the bottom rib having a stretched length and a relaxed length, the relaxed length being shorter than the length of the bottom seam to be formed out of the blank;

(d) forming a shoe cover out of the blank, the shoe cover having an inside surface and an outside surface, the outside surface including a bottom with a bottom seam which runs longitudinally along the length of the bottom; with the bottom rib extending along and through the bottom seam, and being affixed to the bottom seam such that the bottom rib yieldably gathers the material of the bottom along the bottom seam, with the bottom rib being at least partly exposed on the outside of the cover along the bottom seam.

14. The method of claim 13 wherein the bottom rib is also at least partly exposed on the inside of the body along the bottom seam.

* * * * *